United States Patent [19]

Littwin

[11] 4,043,877

[45] Aug. 23, 1977

[54] METHOD FOR THE MANUFACTURE OF MICROSCOPICALLY SMALL METAL OR METAL-ALLOY STRUCTURES

[75] Inventor: Burkhard Littwin, Hohenschaeftlarn, Germany

[73] Assignee: Siemens Aktiengesellschaft, Berlin & Munich, Germany

[21] Appl. No.: 667,074

[22] Filed: Mar. 15, 1976

[30] Foreign Application Priority Data

Mar. 19, 1975 Germany ..... 2512115

[51] Int. Cl.[2] ..... C25D 5/02; C25F 3/14

[52] U.S. Cl. ..... 204/15; 204/129.43

[58] Field of Search ..... 204/15, 40, 43 R, 43 T, 204/129.4, 129.43

[56] References Cited

U.S. PATENT DOCUMENTS

| | | | |
|---|---|---|---|
| 3,560,358 | 2/1971 | Black | 204/129.4 |
| 3,901,770 | 8/1975 | Littwin | 204/15 |
| 3,919,055 | 11/1975 | Urban | 204/15 |
| 3,963,587 | 6/1976 | Kreckel | 204/43 T |

OTHER PUBLICATIONS

AIP Conference Proceedings, No. 5, 1971, pp. 215–219.
Applied Physics Letters, vol. 17, No. 8, Oct. 15, 1970, pp. 328–332.
Journal of Applied Physics, vol. 42, No. 4, Mar. 15, 1971, pp. 1362–1363.

*Primary Examiner*—T. M. Tufariello

*Attorney, Agent, or Firm*—Hill, Gross, Simpson, Van Santen, Steadman, Chiara & Simpson

[57] ABSTRACT

A method of manufacturing microscopically small metal structures which are used in a memory which has cylindrical magnetic domains or magnetic bubbles characterized by creating patterns or channels in a first photo-resist layer disposed on an Ni-Fe layer which was vapor deposited on a storage layer to expose portions of the Ni-Fe layer corresponding to a pattern for guide loop generators, domain annihilators, control lines and/or read lines, electroplating a first gold layer on the Ni-Fe layer, electroplating a Ni-P layer on the first gold layer, and then placing a second and third gold layer successively on top of the Ni-P layer, removing the first photo-resist layer, applying a second photo-resist layer and forming channels or patterns therein to expose portions of the Ni-Fe layer which patterns or channels correspond to the manipulative patterns or domain extenders, electroplating a fourth gold layer in the exposed portions of the Ni-Fe layer, depositing a thick Ni-Fe layer on the fourth gold layer and then removing the second photo-resist layer, applying a third photo-resist layer, exposing and developing the third photo-resist layer to leave the photo-resist layer on the portions to form the detector strips and portions overlapping read line, removing the Ni-Fe layers which have been vapor deposited on the storage layer by etching the zones which are free of the photo-resist and subsequently removing the third photo-resist layer.

24 Claims, 14 Drawing Figures

METHOD FOR THE MANUFACTURE OF MICROSCOPICALLY SMALL METAL OR METAL-ALLOY STRUCTURES

BACKGROUND OF THE INVENTION

1. Field of the Invention

The present invention is directed to a method of manufacturing microscopically small metal or metal alloy structures particularly for manufacturing structures used in a memory for cylindrical magnetic domains which memory has manipulation patterns, domain extenders, detectors, guide loop generators, domain annihilators, control lines and read lines disposed on a storage layer.

2. Prior Art

In devices such as memories involving cylindrical magnetic domains generally called bubbles, the coating width of the structure for example a magnetostriction-free Ni-Fe structure for the manipulation patterns of the cylindrical magnetic domains is approximately 3 to 20 μm. Thus, it is extremely difficult in these devices to use photo-etching procedures due to problems of keeping undercutting during the etching step sufficiently small so that the lateral errosion of the structure in the zones protected by the photo-resist is sufficiently small. In order to avoid these difficulties, several different methods have been suggested and these methods are described in the following articles: V. Sadagopan, H. Hatzakis, K. Y. Ahn, T. S. Plaskett and L. L. Rosier, "High-Density Bubble Domain Shift Register" *AIP Conference Proceedings,* No. 5, 1971, pages 215–219; E. G. Spencer, P. H. Schmidt and R. F. Fischer, "Microstructure Arrays Produced by Ion Milling", *Applied Physics Letters,* vol. 17, No. 8, Oct. 15, 1970, pages 328–332; and J. P. Reekstin, "Fabrication of 'Bubble' —Propagating Circuits by Electroless Deposition of Nickel-Cobalt-Phosphorous", *Journal of Applied Physics,* vol. b 42, No. 4, Mar. 15, 1971, pages 1362–1363. In addition, my United States Letters Patent No. 3,901,770 discusses a process for overcoming the problems of forming microscopically small structures. In this patent, it is suggested that a thin metal or metal alloy layer be vapor deposited on a carrier such as a glass carrier to a thickness of approximately 300 A. In the area of the cylindrical magnetic domain transport, a photo-resist layer is applied onto the metal layer. Channels corresponding to the desired metal or metal alloy structure are formed in the photo-resist layer in accordance to known methods such as photolithography to expose portion of the metal or metal alloy layer. A thin gold layer is then galvanically deposited on the exposed metal or metal layer and a thicker metal or metal alloy is then galvanically deposited on the gold layer with a second gold layer deposited on the metal alloy layer. After removing the photo-resist layer, the underlying thin metal film is removed. Preferably, the metal layer was a Ni-Fe layer and the removing was accomplished by etching the exposed Ni-Fe layer by dipping the coated carrier into a weak acid gold bath wherein the vapor deposited Ni-Fe layer is removed and replaced by a gold layer which gold layer is subsequently removed by etching with a known gold etching agent, for example, a diluted KCN solution. The process described in this patent is easy to carry out procedure and produces very great edge sharpness or border resolution for the structure being formed. In addition, the dimensions of the structure are not significantly influenced by the etching effects, for example undercutting during the etching process.

SUMMARY OF THE INVENTION

The present invention is directed to a method which is an improvement over the method described in the above mentioned United State patent. In particular, the method is suited for the manufacture of manipulation patterns, and domain extenders for cylindrical magnetic domains of a memory and maintains a satisfactory yield of the metal microstructures which have an increased long term stability and which microstructures may include the manufacture of conductor loop generators, domain annihilators, control lines, read lines and detector strips.

The method for producing the metal or metal alloy structures particularly the method for manufacturing of a memory with cylindrical magnetic domains on one storage layer comprises the steps of providing the storage layer; vapor depositing an Ni-Fe layer on the surfaces of the storage layer; providing a first photo-resist layer on the Ni-Fe layer; exposing the photo-resist layer with at least one pattern corresponding to a pattern selected from a group including patterns for guide loop generators, domain annihilators, control lines and read lines; developing the first photo-resist layer to form a channel or pattern exposing a portion of the Ni-Fe layer corresponding to each of the selected patterns; electroplating a first gold layer on the exposed portions of the Ni-Fe layer; electroplating a nonmagnetic Ni-P layer on the first gold layer; electroplating a second gold layer on the nonmagnetic layer; electroplating a third gold layer on the second gold layer; subsequently removing the remaining portions of the first photo-resist layer; applying a second photo-resist layer; exposing the second photo-resist layer with at least one pattern corresponding to the desired manupilation pattern and domain extenders; developing the photo-resist layer to expose the Ni-Fe layer with a pattern corresponding to each of said patterns; electroplating a fourth gold layer on the exposed Ni-Fe layer; electroplating a thick Ni-Fe layer on the fourth gold layer; removing the remaining portions of the second photo-resist layer; applying a third photo-resist layer; exposing the third photo-resist layer for the desired pattern for the detector strips with said pattern overlapping portions of the read lines; developing the third photo-resist layer to remove all portions except that for the desired detector strips; etching away the exposed Ni-Fe layer which was vapor deposited on the storage layer; and removing the remaining portion of the third photo-resist layer.

This method makes is possible to manufacture structures with the desired measurements which preferably lie between approximately 1 and 20 μm, structures with the required layer thicknesses, and structures which are true to the mask and reproducible. The uniform thickness and edge sharpness or border resolution of the structures as well as the good yield during produection are especially guaranteed by the thin gold layer.

During electroplating of an Ni-Fe alloy, the first or initil 10 nm of the layer of the alloy exhibits a significantly higher iron content than the following zones of the layer being deposited. This higher iron content has an unfavorable effect on the adhesion of the Ni-Fe layer on the carrier. Also, the adhesion of a pure Ni layer is approximately twice as great as the adhesion of a Ni-Fe layer which layers are produced by constant plating current of the same value. Therefore, in order to increase the adhesive strength of the electroplated Ni-Fe layers, it is proposed that the plating current be brought from an initial value to a maximum value either continuously or in a stepwise manner. Preferably, the time lapse before the maximum value of current is reached is approximately 30 to 240 seconds. Preferably, it is also desired that the initial plating current is selected to be smaller than 50% of the maximum value. To further improve the adhesive strength of the Ni-Fe layer that is being plated, an additive is added to the Ni-Fe bath to increase its viscosity. An example of this additive is glycerine.

If gold layers and Ni-Fe layers are applied directly one on top of the other without an insulating intermediate layer therebetween, undesirable physical effects can result. For example, when the layers are subjected to thermal stresses, the diffusion of the gold into the Ni-Fe layer will change the magnetic values of the Ni-Fe layer, cause a deterioration of the magnetism and cause loosening of the gold layer so that it will readily peel off.

In order to avoid these long term effects, it is desirable to insulate the Ni-Fe layer from the gold layer being applied thereto. This insulating of the Ni-Fe layer is accomplished by galvanically depositing a nonmagnetic Ni-P intermediate layer. Due to the nonmagnetic properties of the intermediate layer, which in itself, already has a diffusion-inhibiting action, the otherwise possible influencing of the magnetic stray fields of the Ni-Fe layer on the cylindrical magnetic domains is avoided and an unfavorable influencing of the magnitic properties of the manipulation pattern due to the magnetic coupling effects is prevented. The phosphorous component can be incorporated in the nickel layer by addition of sodium-hypophosphite ($NaH_2PO_2$) to the Ni bath.

Tests were made on two types of samples, one type of sample had the Ni-Fe layer separated from a gold layer by an Ni-P intermediary layer of a thickness of 100 nm and the other type of samples had the Ni-Fe layer directing on the gold layer without any intermediary layer. When both types of samples were annealed for 1 hour at 280° C, the coercive force of the Ni-Fe layer on the gold in the samples without the intermediary layer was almost twice the force which occurred in the samples having the intermediary layers.

Assuming that the gold layer applied onto the Ni-Fe layer is very thin, it is possible to electroplate this gold layer and then to electroplate the Ni-P layer on the gold layer. This produces a structure without the occurrence of noticeable impairments in the long term stability which structure approaches the long term stability that is obtained when the Ni-P layer is applied directly on the Ni-Fe layer.

In order to manufacture control and read lines formed of gold, a thin gold layer, which is a preliminary layer, is electroplated on the corresponding zones of the vapor deposited Ni-Fe layer and a Ni-P layer is electroplated on the preliminary gold layer. Then an additional or main gold layer is electroplated on the Ni-P layer which additional gold layer forms the control or read lines which consist of the gold from both the pre- and the main plating process. The initial thin gold preplating of the exposed Ni-Fe layer, which corresponds to the desired pattern, in accomplished in a weak acid pre-gold plating bath, which eliminates any thin passivating surface layers which may be present on the Ni-Fe layer. The following Ni-P layer protects the thin vapor deposited Ni-Fe layer, which has a thickness of 300 A, from diffusion of the subsequently electroplated main gold layer, which will have a thickness of 5000 A. If no Ni-P intermediate layer, which has a thickness of approximately 100 A, is present, the thick gold layer will tend to separate from the base after being annealed at 350° C for a period of 1 hour.

In a preferred embodiment for manufacturing control lines and read lines, a photo-resist layer is first applied on an Ni-Fe layer, which is approximately 300 A thick and which has been vapor deposited on a storage layer. The photo-resist layer is exposed with a pattern corresponding to the desired conductors or lines by means of a photolithographic process and then developed to expose desired portions of the Ni-Fe layer. Subsequently, the exposed Ni-Fe layer is pre-gold plated in a gold plating bath with a current density of 0.6 mA/cm$^2$ for a period of 3 minutes. After pre-gold plating, the nonmagnetic Ni-P layer is applied to the pre-gold layer by using an Ni bath and a current density of 1 mA/cm$^2$ for a period of six minutes. The Ni bath is an Ni-sulfanate both which has been mixed with an additive ($NaH_2PO_2$) in the amount of 1.5 grams per 100 ml of the bath. After plating the Ni-P layer, the device is placed in a gold plating bath and the main gold plating is carried out with a current density of 0.6 mA/cm$^2$ for a period of twenty minutes and both the bath and the carrier which is being coated are placed in motion during the main plating process. The total thickness of the read and control lines constructed in this way amount to approximately 0.4 $\mu$m and the resistant of the gold layer lies between 0.3 $\mu\ \Omega$ cm and 4.0$\mu\ \Omega$ cm.

As mentioned hereinbefore, subsequent to forming the various metal structures, the uncoated, vapor deposited Ni-Fe layer is removed. An example of a process for removing this layer is by dipping the carrier into a weak acid gold bath wherein the vapor deposited Ni-Fe layer is removed by dissolving and is replaced by a gold layer of a corresponding thickness. Subsequently, the gold layer is etched away by means of a known gold etching agent, for example a diluted KCN solution.

The removal of the vapor deposited Ni-Fe layer in the gold bath may be accelerated by alternately applying a positive and a negative potential to the vapor deposited Ni-Fe layer which potential is connected to a metal electrode introduced into the fold bath. The relationship of the times at which the positive and negative potentials are connected to the vapor deposited Ni-Fe layer is selected so that the length of time for removal predominates. The amount of gold deposited during the shorter period of application is also completely removed so that after completion of the process, the vapor deposited Ni-Fe layer, as well as the equivalent gold layer, are removed from the carrier and the subsequent etching of the gold in an etching solution is not necessary.

In the preferred sample embodiment, in order to remove the undesired portion of the vapor deposited Ni-Fe layer which has a thickness of 300 A, the substrate is placed in the acid gold bath and the bath current is adjusted to a current density of 5 mA/cm$^2$. If the period of alternately applying the positive and negative potentials is selected so that the period for removal is approximately one second and the period that gold is applied is approximately 0.5 seconds, the vapor deposited Ni-Fe layer will be removed after approximately three to four minutes. Since it has been shown that a removal current alone will not effect the removal operation, the periodic changing or reversing the direction of the current flow is an important step of the removal process.

DESCRIPTION OF THE PREFERRED EMBODIMENTS

The principles of the present invention are particularly useful for providing a method for producing microscopically small metal structures on a carrier such a memory for cylindrical magnetic domains commonly referred to as magnetic bubbles.

Figure 1:
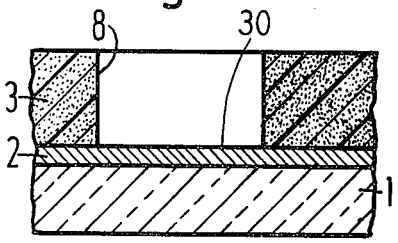
FIGS. 1 through 9 are cross-sectional views illustrating stages of the method in accordance with the present invention.

As illustrated in FIG. 1, an Ni-Fe layer 2, which is approximately 200 to 300 A thick, is vapor deposited on a carrier 1, such as glass plate and for example a storage layer. A first photo-resist layer 3 is then applied to the Ni-Fe layer 2, exposed and developed, such as by using a photolithographic process, to produce channels or patterns 8 which correspond to the desired structure to be formed. The structure may be a guide loop generator, domain annihilators, control or read lines. The channels or patterns 8 leave a portion 30 of the surface of layer 2 exposed for subsequent method steps.

Figure 2:
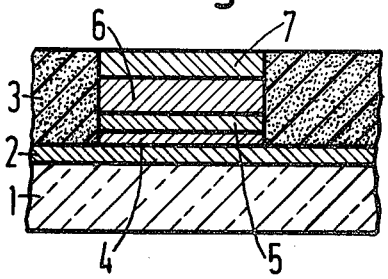

As illustrated is FIG. 2, a first gold layer 4 is electrodeposited onto the exposed portion 30 of the Ni-Fe layer 2 utilizing a conventional gold bath. A nonmagnetic Ni-P layer 5 is electro-deposited on the gold layer 4 by utilizing an Ni-P bath. After applying the layer 5, the carrier 1 is again placed in the gold bath wherein a second gold layer 6 is deposited on the layer 5 and a third gold layer 7 is then placed on the second layer 6. After applying the last gold layer 7, the remaining portions of the first photo-resist layer 3 are removed to produce the structure illustrated in FIG. 3.

Figure 5:
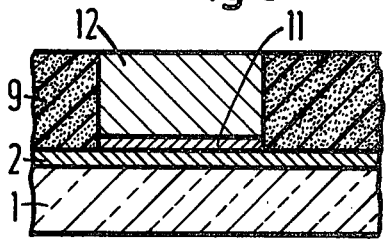
Figure 4:
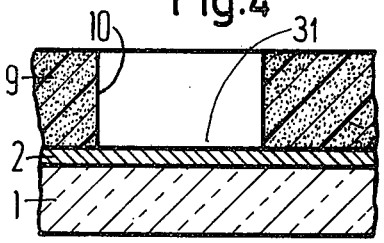

To form either manipulative patterns or domain extenders, a second photo-resist layer 9 is applied on the layer 2 (FIG. 4) exposed and developed to form channels or patterns 10 which correspond to the desired manipulative pattern and/or domain extenders. Each of the channels or patterns 10 leave another exposed portion 31 of the Ni-Fe layer 2 and a fourth gold layer 11 is electroplated on each of the portions 31. After applying the fourth gold layer 11, a thick Ni-Fe layer 12 is electro-deposited on the gold layer 11 (FIG. 5) and subsequently the remaining portions of the second photo-resist layer 9 are removed to produce the structure illustrated in FIG. 6.

Figure 8:
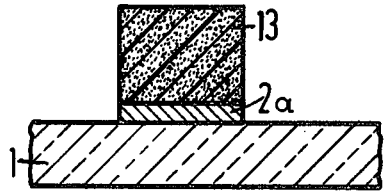
Figure 7:
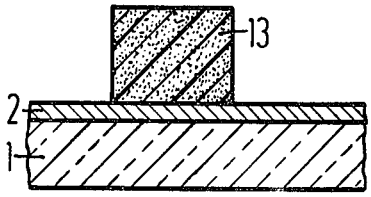
Figure 9:
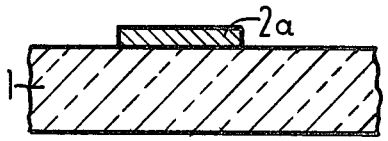

In order to fabricate the desired detector strips which will have portions overlapping read lines, a third photo-resist layer is applied on the surface of the layer 2 and on any layer previously applied to the layer 2. This third photo-resist layer is exposed by means of a positive mask technology and developed to leave portions 13 on the layer 2 (FIG. 7) and on any portions of previously applied layers such as the gold layers of the read lines. Subsequently, the exposed portions of the NI-Fe layer 2 which were vapor deposited on the storage layer 1 are etched away in those zones or areas which are free of photo-resist 13 to produce the structure **2*a* (FIG. 8). Finally, the remaining photo-resist layer 13 is removed (FIG. 9**).

It should be noted that during the step of electroplating the Ni-Fe layer, that the plating current is continously raised from an initial value to the maximum value which continuous raising may be in the stepwise manner. Preferably, the intial value is less than 50% of the maximum value and the period of time for increasing the plating current from the initial current to the maximum current is in the range of 30 to 240 seconds.

Figure 3:
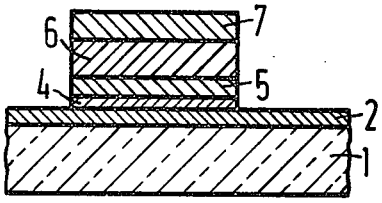

During the step of etching the exposed portion of the Ni-Fe layer 2, the gold layers such as 6 and 7 of FIG. 3 will cover portions of the layer 2 and protect this portion from the etching solution. The etching may be accomplished in a weak acid gold plating bath wherein the Ni-Fe is dissolved and replaced with gold which must be subsequently removed in a gold etching solution. Preferably, the Ni-Fe layers 2, which have been vapor deposited on the carrier 1 is connected in a circuit with an electrode that is introduced in the gold plated bath and positive and negative potentials are alternatively applied to the Ni-Fe layers during the etching process. The duration of the period of applying each of the positive and negative potentials is selected so that the length of time of removal of materials predominates so that the gold which is applied during the normal etching procedure is also removed. Thus, the final step of etching of the gold layer is not necessary.

Figure 10:
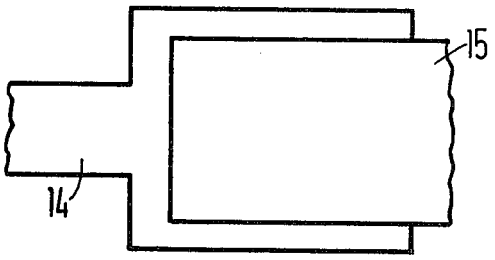
FIG. 10 schematically illustrates the relationship between the detector strip and read line produced in accordance with the present invention.

Since there is a potential difference between the gold layer forming the read lines and the Ni-Fe layer of the detector strips, undercutting and disruptions can occur during the etching process to remove the Ni-Fe layer. Since the transition point between the detector strips and the read lines is extremely critical, these unfavorable effects should be avoided. Preferably, as illustrated in FIG. 10, the surface of the read line or conductor 15 is selected to be smaller than the surface area of the detector strop 14 at the portion in which they overlap (see FIG. 10). Preferably, the edges of the read line 15 are spaced inward from the edges of the detector strip 14 with an equal distance so that the photo-resist layer 13 assumes the configuration of the strip 14 and protects the interface between the read line 15 and the portion 14 of the Ni-Fe layer. By exposing the resist 13 to have a pattern that corresponds to the detector strip 14, the problems of corrosion, which will produce an increase resistance, will not occur at the edges except in those areas which are at non-critical locations.

Figure 6:
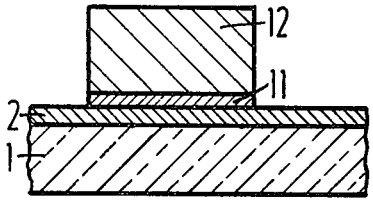
Figure 11:
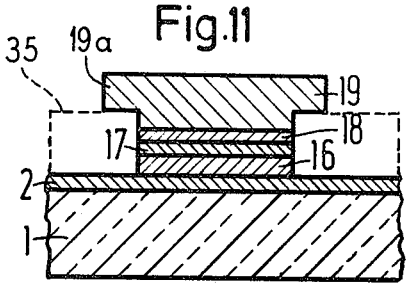
FIG. 11 is a cross-sectional view of a manipulative pattern produced in accordance with an embodiment of the method of the present invention.

When forming the manipulation patterns and the domain extenders, the gold layer such as 11 in FIG. 6 may be separated into two gold layers 16 and 18 by an intermediate Ni-P layer 17 (see FIG. 11). In order to reduce the distance between the edge surfaces of adjacent elements of the manipulative patterns and domain extenders, which edge surfaces are located in the zone of the domain transport, the Ni-Fe layer 19, which is applied on the upper gold layer 18 preferably has at least a portion **19*a* which is wider than the gold layer 18. In order to achieve this structural feature photo-resist layer 35 which is illustrated in broken lines is applied on the Ni-Fe layer 2 which layer has been vapor deposited on the storage layer or carrier 1. The pattern or channel, which corresponds to each of the desired manipulation patterns or domain extenders is formed in the photo-resist layer in accordance with known techniques involving photolithography. A first gold layer 16 is electrically deposited on the exposed portion of the layer 2. Subsequently, the Ni-P layer 17 is applied on the layer 16 and a second or upper gold layer 18 is applied on the layer 17. Finally a Ni-Fe layer 19 is electroplated on the upper or second gold layer 18. To obtain a structure of the layer 19, which has a portion 19***a* that is wider than the layers 18, 17 and 16, the thickness of the photoresist layer 35 and the duration of depositing of both the NI-P layer 17 and the Ni-Fe layer 19 are selected so that at least a portion 19*a* of the Ni-Fe layer 19 extends laterally over the edges of the photo-resist layer 35 and reaches an optimum width which width was selected to provide a minimum allowable distance from adjacent elements of the manipulation patterns. Subsequent to the plating of the Ni-Fe layer 19, the photo-resist layer 35 is removed and the exposed portion of the vapor deposited Ni-Fe layer 2 are removed by the above mentioned etching process.

Figure 12:
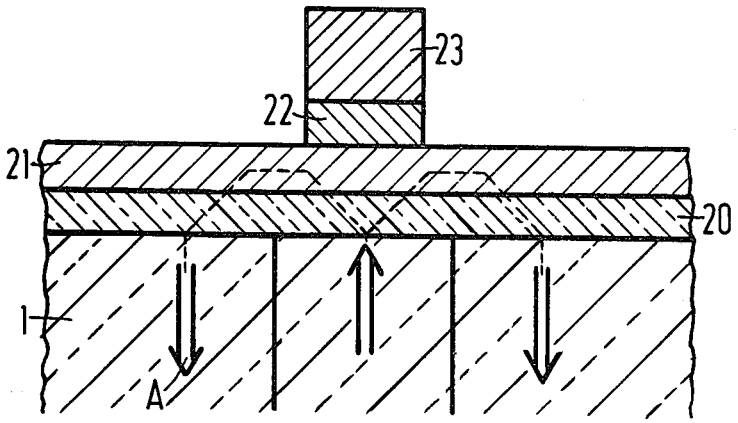
FIG. 12 is a partial cross section of another embodiment of a manipulative pattern produced in accordance with the present invention.

In order to reduce the magnetic coupling between the cylindrical magnetic domains and the Ni-Fe layers of the manipulative latter, a nonmagnetic spacing layer, a so called spacer, is required. For this purpose, the invention provides a layer consisting of a dielectric material, preferably an $SiO_2$ layer 20 (see FIG. 12) which has a thickness of 0.1 to 1 $\mu$m and which was directly srayed or vapor deposited onto the storage layer or carrier 1 prior to vapor depositing the Ni-Fe layer 21. As illustrated in FIG. 12, dielectric spacing layer 20 is partially replaced by the Ni-Fe layer 21 which is equal in effect but thin. After applying the layer 21, an appropriate photo-resist layer is applied, exposed and developed, so that a gold layer 22 can be applied directly onto the Ni-Fe layer 21 with an Ni-Fe layer 23 being deposited on the gold layer 21 to form the manipulative pattern.

Since the magnetic stray field of the cylindrical magnetic domain is reduced at the location of an Ni-Fe bar, which forms the manipulative pattern, the dielectric spacing layer such as 20 reduces the magnetic coupling between the cylindrical magnetic domain and the Ni-Fe bars or elements of the transport structure. The cylindrical magnetic domain is then retained there to a lesser degree if the magnetic rotating field, which influences the conveying of the cylindrical domains along the transport structure, advances. If a soft magnetic Ni-Fe layer is placed between the Ni-Fe bar or element and the storage layer 1, the magnetic stray field of the cylindrical magnetic domains may likewise be reduced at the location of the Ni-Fe bar or elements. Due to its high saturation magnetization, the layer forms a magnetic short circuit for the stray field of the cylindrical domains and those of its surroundings (see the direction of magnetization which is indicated by the arrows A in FIG. 12) and the retaining forces are somewhat reduced. In addition, attention is directed to the fact that the thin gold layer 22 will also prevent exchange coupling between the magnetization of the vapor deposited Ni-Fe layer 21 and the electro-deposited Ni-Fe layers such as 23.

Figure 13:
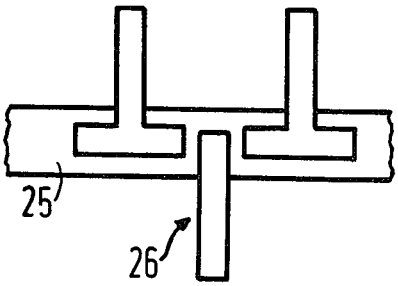
FIGS. 13 and 14 are schematic illustrations of a plan view of the placing of the manipulative patterns.
Figure 14:
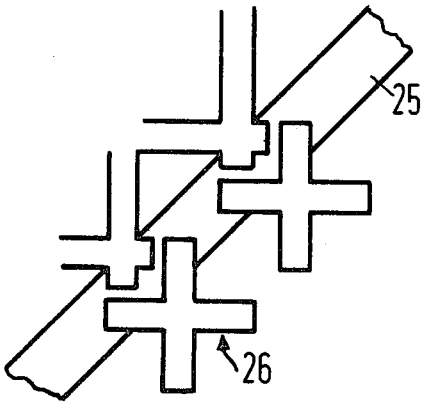

Since the memory for cylindrically magnetic domains also require electrical lines for gates in addition to the manipulative patterns, it is advantageous to maintain either a strip or interrupted portions of the vapor deposited Ni-Fe layer to extend along the transport direction of the cylindrical magnetic domains in order to avoid electrical short circuits. As indicated in FIGS. 13 and 14, the etching of the vapor deposited Ni-Fe layer produces either strips such as 25 or portions such as generally indicated at 26. To produce the strips 25 or the portions 26, the photo-resist layer which is used for the purpose of producing the detector strips is developed to provide the corresponding masking shapes for either the strips 25 or the portions 26. Thus, an additional masking process is not necessary. The most favorable width for the band such as 25 is between 2 and 3 diameters of the cylindrical magnetic domains. If necessary, it is also possible to provide interruptions in either the thin Ni-Fe strips 25 or in the portions 26 at locations which are not critical with regard to the transport path.

Although various minor modifications may be suggested by those versed in the art, it should be understood that I wish to employ within the scope of the patent granted hereon, all such modifications as reasonably and properly come within the scope of my contribution to the art.

I claim:

1. A method for manufacture of microscopically small metal or metal alloy structures particularly a method for manufacture of a memory with cylindrical magnetic domains on one storage layer which memory has manipulative patterns, domain extenders, detector strips, guide loop generators, domain annihilators, control lines, and read lines formed on the storage layer comprising the steps of providing a storage layer; vapor depositing an Ni-Fe layer on a surface of the storage layer; providing a first photo-resist layer on the Ni-Fe layer, exposing the photo-resist layer with at least one pattern corresponding to a pattern selected from a group including patterns for guide loop generators, domain annihilators, control lines and read lines; developing the first photo-resist layer to form a channel exposing a portion of the Ni-Fe layer corresponding to each of the selected patterns; electroplating a first gold layer on the exposed portions of the Ni-Fe layer; electroplating a nonmagnetic Ni-P layer on the first gold layer; electroplating a second gold layer on the nonmagnetic layer; electroplating a third gold layer on the second gold layer; subsequently removing the remaining portions of the first photo-resist layer; applying a second photo-resist layer; exposing the second photo-resist layer with at least one pattern corresponding to the desired manipulation patterns and domain extenders; developing the photo-resist layer to expose the Ni-Fe layer with a pattern corresponding with each of said patterns; electroplating a fourth gold layer on the exposed Ni-Fe layer; electroplating a thick Ni-Fe layer on the fourth gold layer; removing the remaining portions of the second photo-resist layer; applying a third photo-resist layer; exposing the third photo-resist layer for the desired pattern for the detector strips, with said pattern overlapping portions of the read line; developing the third photo-resist layer to remove all portions except that for the desired detector strips; ething away the exposed Ni-Fe layer which was vapor deposited on the storage layer; and removing the remaining portions of the third photo-resist layer.

2. A method according to claim 1, wherein in each step of electroplating an Ni-Fe layer, the plating current is brought from an initial value to a maximum value in a continuous operation.

3. A method according to claim 2, wherein said continuous operation is a stepwise increase of the plating current.

4. A method according to claim 2, wherein the initial plating current is selected to be smaller than 50% of the maximum plating current.

5. A method according to claim 2, wherein the plating current is brought from an initial value to a maximum value in a time having a range of 30 to 240 seconds.

6. A method according to claim 5, wherein the value of the initial plating current is selected to be smaller than 50% of the maximum value for the plating current.

7. A method according to claim 2, wherein each step of electroplating of the Ni-Fe layer occurs in an Ni-Fe bath and wherein said bath has an additive which increases the viscosity of the bath.

8. A method according to claim 7, wherein the additive is glycerine.

9. A method according to claim 1, wherein the step of electroplating the nonmetallic Ni-P layer provides an insulating layer between the Ni-Fe layer and the gold layers.

10. A method according to claim 9, wherein the step of electro-depositing the first gold layer onto the Ni-Fe layer deposits a thin gold layer which is subsequently covered by the step of electrically depositing the Ni-P layer.

11. A method according to claim 1, wherein during the formation of control lines and read lines, a step of depositing a first gold layer on the Ni-Fe layer applies a thin gold layer thereto, and wherein the step of electrically depositing an Ni-P layer on the first gold layer insulates the second gold layer from the first gold layer.

12. A method according to claim 1, wherein the step of removing the vapor deposited Ni-Fe layer comprises dipping the carrier into a weak acid gold bath, and alternately applying a positive and negative potential to the Ni-Fe layer by a metal electrode introduced into the gold bath.

13. A method according to claim 12, wherein the step of alternately applying a positive and negative potential is applied with the period of each potential selected so that the length of time for removal of the Ni-Fe layer predominates.

14. A method according to claim 1, wherein the step of exposing the third photo-resist layer in the area of contact between the read line and the detector strips, said protective resist layer is selected to have an area greater than the area of the read line and overlap the edges of the read lines in equal amount so that during the subsequent step of removing the exposed vapor deposited Ni-Fe layer, the etching agent does not attack the boundary between the gold layer and Ni-Fe layer.

15. A method according to claim 1, wherein during the plating of the fourth gold layer utilizing the second resist layer, said fourth gold layer is applied in two separate plating steps with an electroplating of an Ni-P layer interposed therebetween and wherein the Ni-Fe layer applied to the upper gold layer is at least partially wider than the gold layers.

16. A method according to claim 15, wherein the step of electroplating the Ni-P layer and the step of electroplating the Ni-Fe layer are controlled so that the thickness of each layer is greater than the thickness of the second photo-resist layer and a portion of the Ni-Fe layer extends over the photo-resist layer.

17. A method according to claim 1, which includes applying an $SiO_2$ layer directly on the storage layer prior to the step of vapor depositing the Ni-Fe layer.

18. A method according to claim 17, wherein the $SiO_2$ layer has a thickness in the range of 0.1 to 1 μm and wherein the step of applying the $SiO_2$ layer comprises spraying the $SiO_2$ layer onto the storage layer.

19. A method according to claim 1, wherein the step of exposing the third photo-resist layer covers the vapor deposited Ni-Fe layer in the zones of the magnetic domain transports so that the subsequent etching retains the Ni-Fe layer in these zones.

20. In a method for manufacturing a microscopically small metal or metal alloy structure on a carrier member, the method comprising the steps of providing a carrier member having an Ni-Fe layer vapor deposited on a surface thereof; providing a photo-resist layer on the Ni-Fe layer; exposing the photo-resist layer with at least one desired pattern; developing the photo-resist layer to expose the surface of the Ni-Fe layer corresponding to each of said patterns; electroplating a first gold layer on the exposed Ni-Fe layer, and then electroplating a thick Ni-Fe layer on the gold layer, the improvement comprising increasing the plating current during electroplating of the Ni-Fe layer from an initial value to a maximum value in a continuous operation.

21. In a method according to claim 20, wherein said increasing is by stepwise increases of the plating current.

22. In a method according to claim 20, wherein the initial plating current is selected to be smaller than 50% of the maximum plating current and wherein the plating current is brought from the initial value to the maximum value in a time having a range of 30 to 240 seconds.

23. A method for manufacturing microscopically small metal or metal alloy structures on a carrier member, said method comprising the steps of providing a carrier member having an Ni-Fe layer vapor deposited on a surface thereof, providing photo-resist layer on the Ni-Fe layer channels exposing a portion of the surface of the Ni-Fe layer on which surface the structure is to be formed, electro-depositing a first thin gold layer on the exposed portions of the Ni-Fe layer; electroplating a nonmagnetic Ni-P layer on the first gold layer, and then electroplating at least a second gold layer on the nonmagnetic layer so that the Ni-P layer insulates the Ni-Fe layer and the second gold layer.

24. In a method for manufacturing a microscopically small metal or metal alloy structures on a carrier member having an Ni-Fe layer vapor deposited on a surface thereof and having at least one gold layer electro-deposited on selected areas of the Ni-Fe layer, and subsequently etching exposed portions of the vapor deposited Ni-Fe layer by placing the carrier in a mild acid gold bath, the improvement comprising alternately applying a positive and negative potential to the Ni-Fe layer with the period of time of application of each of said potentials being selected so that the length of time for removal of the Ni-Fe layer predominates.

* * * * *